US011703285B1

(12) United States Patent
Skop

(10) Patent No.: US 11,703,285 B1
(45) Date of Patent: Jul. 18, 2023

(54) APPARATUS AND METHOD FOR LATENT ENERGY EXCHANGE

(71) Applicant: Helen Skop, Skokie, IL (US)

(72) Inventor: Helen Skop, Skokie, IL (US)

( * ) Notice: Subject to any disclaimer, the term of this patent is extended or adjusted under 35 U.S.C. 154(b) by 0 days.

(21) Appl. No.: 18/114,396

(22) Filed: Feb. 27, 2023

(51) Int. Cl.

| | |
|---|---|
| ***F28D 21/00*** | (2006.01) |
| ***F28D 20/02*** | (2006.01) |
| ***F28F 13/08*** | (2006.01) |
| ***F28D 15/02*** | (2006.01) |
| ***F28D 9/04*** | (2006.01) |

(52) U.S. Cl.
CPC ..... *F28D 20/02* (2013.01); *F28D 9/04* (2013.01); *F28D 15/02* (2013.01); *F28D 21/0003* (2013.01); *F28F 13/08* (2013.01)

(58) Field of Classification Search
CPC ..... F28F 13/08; F28D 9/04; F28D 21/0003; F28D 15/02
See application file for complete search history.

(56) References Cited

U.S. PATENT DOCUMENTS

| | | | | |
|---|---|---|---|---|
| 1,609,672 | A | 12/1926 | Stickle | |
| 4,426,959 | A * | 1/1984 | McCurley | F28D 15/0275 285/47 |
| 4,907,647 | A * | 3/1990 | Faller, Sr. | F28D 9/04 165/170 |
| 7,287,580 | B2 | 10/2007 | Harman | |
| 10,989,480 | B2 | 4/2021 | Rock, Jr. et al. | |
| 2010/0008833 | A1 * | 1/2010 | Gulener | F28F 9/027 422/198 |
| 2017/0010046 | A1 | 1/2017 | Hofbauer | |
| 2017/0198978 | A1 | 7/2017 | Kuczek et al. | |
| 2017/0205146 | A1 | 7/2017 | Turney et al. | |
| 2017/0205149 | A1 | 7/2017 | Herring et al. | |
| 2017/0370652 | A1 | 12/2017 | Lopes | |
| 2022/0018605 | A1 | 1/2022 | Krupa et al. | |

FOREIGN PATENT DOCUMENTS

| | | | | |
|---|---|---|---|---|
| CN | 111076572 A * | 4/2020 | | F28D 7/022 |
| EP | 794401 A2 * | 9/1997 | | F28B 1/06 |
| WO | WO-03011418 A1 * | 2/2003 | | B01D 3/14 |

OTHER PUBLICATIONS

N. Souidi, A. Bontemps, "Reflux condensation in narrow rectangular channels with perforated fins," Applied Thermal Engineering, 2003, 23. pp. 871-891 (Year: 2003).*

* cited by examiner

*Primary Examiner* — Eric S Ruppert
(74) *Attorney, Agent, or Firm* — Martin J. Wolff

(57) ABSTRACT

An energy exchanger for exchanging energy between a hot flow and a cold flow may comprise a hot flow section and a cold flow section, each of the sections comprising the same quantity of channels having variable cross sections. The inlets of the hot flow channels may be juxtaposed to the outlets of the cold flow channels and the outlets of the hot flow channels may be juxtaposed to the inlets of the cold flow channels such that the hot and cold flows move in opposing directions. The energy exchanger may further comprise a liquid distribution system and a common interface between each hot flow channel and a corresponding cold flow channel with an exponentially varying surface area adapted for exchanging latent energy released through condensation in the hot flow section and absorbed through evaporation in the cold flow section.

20 Claims, 9 Drawing Sheets

APPARATUS AND METHOD FOR LATENT ENERGY EXCHANGE

This material is based upon work supported by the National Science Foundation under Award No. 2124735: "Innovative Latent Energy Exchanger for Effective Recovery of Industrial Wet Exhausts".

BACKGROUND

There is a wide spectrum of fired and unfired heating applications (boilers, baking ovens, dryers, heat treating furnaces, proofers, HVAC, etc.) which generate wet exhausts, resulting in a tremendous amount of energy wasted into the environment. Over 80% of this unrecovered energy is "low temperature" waste heat with a high thermal value due to the latent heat of its water vapor content. This heat is lost because of technical inefficiencies in off-shelf heat transfer equipment, which are primarily designed to handle sensible heat and are unable to efficiently recover latent energy from the relatively low temperature wet exhausts.

For the equipment that are commonly used in waste heat recovery applications, the predominant heat recovery mode is through sensible heat, leaving the much of the potential recovery from available latent energy untouched. State of the art latent energy recovery systems typically employ a combination of a single-phase process for transferring latent energy with sensible heat transfer. Because the latent energy associated with a phase change is many times higher than the thermal energy required for a temperature change, there is an opportunity to reduce the amount of energy wasted in wet exhausts through improving the energy recovery from a wet gas exhaust by balancing latent energy recovery with a reverse phase change process. As an example, for a process of water vapor condensation and water recovery in wet exhaust flow associated with latent energy transfer and water recovery, a process of evaporation in an opposite flow, i.e., air humidification, would potentially balance the condensation and improve the amount of energy recovered from the wet exhaust. Such a combination may be beneficial, for example, in a bakery where condensation of the oven exhaust vapor can be exchanged for humidification of air in a proofer. Similarly, for a heating and ventilation system, cooling an exhaust with condensation can be used to heat and humidify air for circulation.

SUMMARY OF THE INVENTION

The present inventive subject matter is directed to an apparatus and method for latent energy exchange. Exponential variation of a common interface's surface area in counterflowing channels of the energy exchanger maintains the temperature and pressure of a gaseous mixture comprising a non-condensable gas and condensable gas at saturation for condensation to occur continuously on one side of the energy exchanger simultaneously with evaporation of a liquid introduced into a non-condensable gas mixture on the other side of the energy exchanger. The temperature change along the energy exchanger is nearly linear while the temperature difference between the channels is approximately constant at any location as measured from one end of the energy exchanger. This exchange of latent energy from the combination condensation and evaporation is far more effective and stable than that for conventional heat exchangers that rely primarily on transfer via sensible heat because of the inherently higher energy associated with phase changes and the use of different heat transfer mechanisms.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanied drawings in which:

Figure 1:
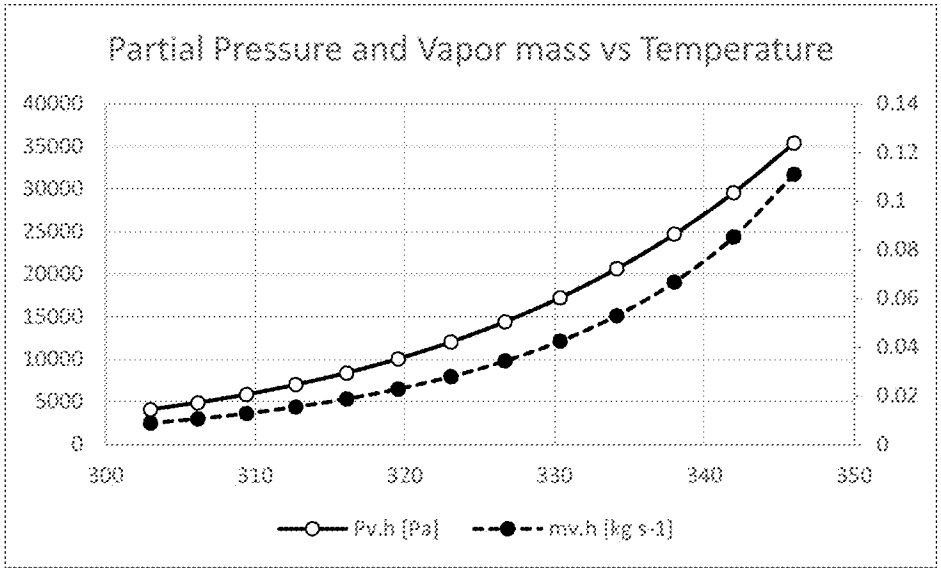
FIG. 1 is a graph showing the relationship between the partial pressure of vapor and temperature as well as the relationship between vapor mass and temperature for saturated air over a range of temperatures.

It will be appreciated that for simplicity and clarity of illustration, elements shown in the drawings have not necessarily been drawn accurately or to scale. For example, the dimensions of some of the elements may be exaggerated relative to other elements for clarity or several physical components included in one functional block or element. Further, where considered appropriate, reference numerals may be repeated among the drawings to indicate corresponding or analogous elements. Moreover, some of the blocks depicted in the drawings may be combined into a single function.

DETAILED DESCRIPTION

In the following description, various aspects of the present invention will be described. For purposes of explanation, specific configurations and details are set forth to provide a thorough understanding of the present invention. However, it will also be apparent to one skilled in the art that the present invention may be practiced without the specific details presented herein. Furthermore, well-known features may be omitted or simplified in order not to obscure the present invention.

As used herein, a hot flow is a hot gas mixture comprising a mixture of non-condensable gas and condensable gas as vapor at any mass concentration of the vapor in a state that is sufficiently close to saturation so that condensation of the condensable gas can occur. If the temperature of the mixture is too high, it must be cooled sufficiently to the point at which condensation can occur. One example of such a hot flow is a wet exhaust is hot air with a water vapor content in excess of 10% by mass. Furthermore, as used herein a cold flow is a cold gas or gas mixture containing little or no condensable gas. In the present invention, a liquid may be introduced to the cold flow in the energy exchanger under conditions that may evaporate enough of the liquid to approach saturation of the new mixture. An example of such a cold flow is air at an ambient temperature to which water at ambient or lower temperature may be added in the energy exchanger.

The term latent energy transfer or exchange is the transfer or exchange of energy during a phase change from an energy containing medium to another medium with a reversing phase change process. As used herein for a fluid medium, a latent energy transfer can be gas to liquid transferring energy to another fluid medium through liquid to gas as a reversing phase change process. Alternatively, a reversing phase change for gas to liquid may also be a solid to liquid. Other combinations of reversing phase changes wherein the subtraction of latent energy from a medium is balanced by the addition of latent energy to another medium are also possible. For a wet exhaust in which there is significant moisture, the temperature at which the phase transition of the moisture to liquid occurs is determined by a combination of the partial pressures of the vapor and gas or gases present in the exhaust. As is known in the art, the latent energy present in a wet exhaust comprising air and water vapor for example is determined by the mass content of water vapor in the flow and is dependent on the partial pressure of the vapor. This partial pressure changes exponentially with temperature during fully saturated flow that is cooled according to the Clausius-Clapeyron equation.

In a first illustrative embodiment, an energy exchanger for exchanging energy between a hot flow and a cold flow may comprise a hot flow section, a cold flow section, a liquid distribution system, and a common interface. The hot flow section may comprise a quantity of hot flow channels with each channel having a variable cross section. Each hot flow channel may comprise a hot flow inlet, a hot flow outlet, and a passage having a length for the hot flow to move from the hot flow inlet to the hot flow outlet. The cold flow section may comprise the same quantity of cold flow channels as hot flow channels with each channel having a variable cross section. Each cold flow channel may comprise a cold flow inlet, a cold flow outlet, and a passage having a length for the cold flow to move from the cold flow inlet to the cold flow outlet with the inlets of the cold flow channels juxtaposed to the outlets of the hot flow channels and the outlets of the cold flow channels juxtaposed to the inlets of the cold flow channels such that the hot flow and the cold flow move in opposing directions through the energy exchanger.

The liquid system may distribute liquid into each of the cold flow channels. The common interface may be between each hot flow channel and a corresponding cold flow channel and may have a varying surface area in each of the hot and cold flow channels. The varying surface areas may be adapted for exchanging latent energy released through condensation in the hot flow section and absorbed through evaporation in the cold flow section. The varying surface areas may taper at an exponential rate from the inlets of the hot flow channels to the outlets of the hot flow channels and expand at an inverse of the hot flow channels' exponential tapering rate from the inlets of the cold flow channels to the outlets of the cold flow channels.

The combination of the varying surface area of the common interface, the variations of the hot and cold flow channels' cross sections may maintain the hot flow at saturation, reduce a vapor partial pressure of the hot flow in proportion to the tapering of the varying surface areas of the hot flow channels, reduce a temperature of the hot flow linearly along the length of the hot flow channels, maintain the cold flow at saturation, increase a vapor partial pressure of the cold flow in proportion to the expansion of the varying surface areas in the cold flow channels, and increase a temperature of the cold flow linearly along the length of the cold flow channels such that there is a constant temperature difference between the hot flow and the cold flow at any distance as measured from the inlets of the hot flow channels and as measured at any distance from the outlets of the corresponding cold flow channels.

In a second illustrative embodiment, an energy exchanger for exchanging energy between a hot flow and a cold flow may comprise a hot flow channel forming a logarithmic spiral and having variable cross section, a cold flow channel forming a logarithmic spiral congruent to the hot flow logarithmic spiral and having variable cross section, a liquid distribution system, and a common interface between the hot flow channel and the cold flow channel. The hot flow channel may comprise a hot flow inlet, a hot flow outlet, and a passage having a length for the hot flow to move from the hot flow inlet to the hot flow outlet. The cold flow channel may comprise a cold flow inlet, a cold flow outlet, and a passage having a length for the cold flow to move from the cold flow inlet to the cold flow outlet. The cold flow outlet may be adjacent to the hot flow inlet and the cold flow inlet may be adjacent to the hot flow outlet such that the hot flow and the cold flow move in opposing directions through the energy exchanger.

The liquid distribution system may distribute liquid for evaporation into the cold flow channel. The common interface may have a varying surface area in the hot flow channel tapering at an exponential rate from the hot flow inlet to the hot flow outlet, adapted for transferring latent energy released through condensation, and a varying surface area in the cold flow channel tapering at the same exponential rate as the varying surface are in the hot flow from the cold flow outlet to the cold flow inlet, adapted for transferring latent energy for absorption through evaporation.

The exponential variation in in the hot flow channel surface area of the common interface may maintain the hot flow at saturation, reduce a vapor partial pressure in proportion to the tapering of the hot flow channel surface area, and reduce a temperature of the hot flow linearly along the length of the hot flow channel. The exponential variation in the cold flow channel surface area of the common interface may maintain the cold flow at saturation, increase a vapor partial pressure in inverse proportion to the tapering of the hot flow channel surface area, and increases a temperature of the cold flow linearly along the length of the cold flow channel such that there may be a constant temperature difference between the hot flow and the cold flow as measured at any distance from the inlet of the hot flow channel and as measured from the outlet of the cold flow channel.

A third illustrative embodiment of the present invention may comprise a method for exchanging latent energy and sensible energy between a hot flow and a cold flow. The method may include injecting the hot flow into a hot flow section of an energy exchanger, the hot flow section comprising a quantity of hot flow channels, each of the hot flow channels having a variable cross section and comprising a hot flow inlet, a hot flow outlet, and a passage having a length for hot flow to move from the hot flow inlet to the hot flow outlet.

The method may also include injecting the cold flow into a cold flow section of the energy exchanger, the cold flow section comprising a quantity of cold flow channels, each of the cold flow channels having a variable cross section comprising a cold flow inlet, a cold flow outlet, and a passage having a length for the cold flow to flow move from the cold flow inlet to the cold flow outlet. The quantity of cold flow channels may be the same as the quantity of hot flow channels. The inlets of the cold flow channels may be juxtaposed to the outlets of hot flow channels, and the outlets of the cold flow channels may be juxtaposed to the inlets of the hot flow channels such that the hot flow and cold flow may move in opposing directions through the energy exchanger.

The method may further include injecting liquid into each of the cold flow channels through a liquid distribution system and exchanging energy across a common interface between each hot flow channel and a corresponding cold flow channel. The common interface may have a varying surface area in each of the hot flow channels and in each of the cold flow channels with the varying surface areas configured for exchanging latent energy released through condensation in the hot flow section and absorbed through evaporation in the cold flow section. The varying surface areas may taper exponentially at an exponential from the inlets of the hot flow channels to the outlets of the hot flow channels and may expand exponentially at an inverse of the hot flow channel exponential tapering rate from inlets of the cold flow channels to the outlets of the cold flow channels.

The method may further include maintaining the hot flow at saturation, reducing a vapor partial pressure of the hot flow in proportion to the tapering of the varying surface areas in the hot flow channels, reducing a temperature of the hot flow linearly along the length of the hot flow channels, distributing liquid into each of the cold flow channels, maintaining the cold flow at saturation, increasing a vapor partial pressure of the cold flow in proportion to the expansion of the varying surface areas in the cold flow channels, increasing a temperature of the cold flow linearly along the length of the of the cold flow channels such that there may be a constant temperature difference between the hot flow and the cold flow at any distance as measured from the inlets of the hot flow channels and as measured from the outlets of the corresponding cold flow channels, removing condensate from the hot flow section, removing residual liquid from the cold flow section, expelling the hot flow through the outlets of the hot flow channels, and expelling the cold flow through the outlets of the cold flow channels.

The present invention provides a system for rich energy and water recovery from a wide spectrum of industrial, commercial, and residential applications that emit a wet exhaust or other hot flow to the environment, thereby improving the overall energy efficiency and process stability, reducing energy consumption, and saving water, while reducing the carbon footprint of these operations as compared to existing systems. An output of heated and humidified cold flow of air, for example, may be used for maintaining the environment of a moist product, instead of the commonly used generation of steam and air. Alternatively, the present invention may be used to exchange energy between two gases or to transfer moisture from one gas to another.

According to state-of-the-art best practice, the designs of latent heat exchangers that employ a phase change process such as condensation or evaporation on one side typically employ a sensible energy transfer. i.e., single-phase heating or cooling on another side that changes the temperature of the medium on that side. As a result, there is a large gap between the latent energy available and the capacity on the other side to absorb that latent energy. Some limiting factors on single-phase heating or cooling include high thermal resistance of the interface, excessive flow rate, high temperature difference, heat sink temperature and others, coupled with the assumption that the temperature distribution along the heat exchange channel or channels is linear as is accepted for typical sensible heat exchangers. Such an assumption prevents available systems from deep energy and water recovery because the actual temperature distribution of the sensible energy process during latent energy transfer has a non-linear nature due to exponential dependency of partial pressure of vapor in saturated flow on the interface surface area. Furthermore, when the wall temperature in a heat exchanging channel rises above the flow saturation point preventing condensation, the latent energy transfer stops and only sensible heat exchange continues, thereby further limiting the energy transfer capacity of the heat exchanger.

To enable deep and efficient latent energy transfer from a wet exhaust or other hot flow, the present invention replaces the single phase, i.e., sensible energy, process with a matching reversed phase change, i.e., latent energy process by maintaining a linear temperature distribution and saturation conditions through vapor partial pressure control along the passages of the hot flow and cold flows in the latent energy exchanger. Controlling the temperature and pressure inside the hot and cold flow channels may provide conditions close to the saturation point in both sets of channels such that latent energy transfer can occur via a common interface throughout the extent of the channels at a nearly constant and small temperature difference, such as for example a range of 3K to 5K, between counterflowing hot and cold flow channels at any location as measured from one common end of the channels. This resulting process may not only be stable but may also recover a greater amount of energy than is possible with a single phase-change device for the same hot flow input.

FIG. 1 is a graph that illustrates the relationship between the partial pressure of vapor and temperature as well as the relationship between vapor mass flow and temperature for saturated air over a range of temperatures on the Kelvin (K) scale on the horizontal axis. The partial pressure curve is that indicated by the solid line with the unfilled dots as measured in pascals (Pa) on the left axis. The vapor mass flow curve is that indicated by the dotted line with the filled dots as measured in kg per second on the right axis (kg s−1). The partial pressure of vapor increases exponentially with temperature and defines the vapor mass change behavior.

By exponentially varying the interface surface area between the hot and cold flows and possibly the cross sections along the lengths of their respective channels, both the partial vapor pressure and the temperatures of both flows may be controlled for given hot and cold flow rates in a counterflowing latent energy exchanger such that energy may be extracted by a condensing phase change along substantially the entire length of the hot flow channel or channels. This extracted energy may be absorbed by a an evaporation phase change in the cold flow along substantially the entire length of the cold flow channel in the reverse or opposite direction due to the similarity between the respective channels' geometric parameters such as, for example, interface surface area, heat transfer surface area, channel width, or other channel dimensional functional dependence on location in the respective channels related to the interface, with corresponding process parameter relationships among, for example, partial pressures, vapor mass flow, latent heat, and temperature whose variations with location are similar to those of the channels' geometric parameters. With such variations, a constant or nearly constant temperature difference can be sustained between hot and cold flows.

Achieving this balance of energy exchanging phase changes continuously throughout a latent energy exchanger may be accomplished by exponentially varying the surface areas of the common interface between hot and cold flows as a function of location along the length of the hot flow passage from an entry and along the length of the cold flow passage in the reverse direction of the cold flow from an exit. The energy transferring capacity also varies as a function of the surface areas of the interface in each channel.

The combination of exponentially varying surface area and possibly at least one dimension of cross section related to the interface may cause partial vapor pressure to change exponentially with distance along the channel and temperature to change linearly or nearly linearly in the hot and cold flows thereby assuring both the phase change and the matching reverse phase change are sustained substantially along the length of both flows at a constant or nearly constant small temperature difference as measured at any location along both passages.

At the same time, sensible heat is also released when the hot flow cools and accompanies the release of latent energy during condensation. Sensible heat from cooling the non-condensing part of the mixture is released evenly throughout the channel as the temperature decreases linearly and with a constant temperature difference between hot and cold flows. Sensible heat from the vapor part of the mixture decreases along the channel along with a decrease in its mass during the condensation process. Similar sensible heat transfers occur in a cold flow.

The geometric configuration of a latent energy exchanger that harnesses these design concepts of the present invention may take many forms. In some embodiments there may be only one channel for each of the hot and cold flows, while other embodiments may comprise two or more channels. The channels may have a rectangular cross section with a height and width for which one or both vary along the channel length. Other cross sections such as oval, circular, or polygonal with flat and curved side walls are also possible. The hot flow and cold flow channels may also be adjacent and coaxial with respect to each other. Another alternative may be for the hot and cold channels to be located at different places and connected only by one or more heat transfer surfaces such as for example loop heat pipes. Furthermore, the channels may be straight along their length or curved in a single plane or three dimensionally, or a combination of the two.

In some preferred embodiments of the present invention, the configuration of the channels may be curved to form a logarithmic spiral as is known in the art. Some advantages of the logarithmic spiral stem from its self-similarity, which ensures a stable repetition of dimensional parameter ratios along the length of the channels. The formation of one or more channels between the curves of a logarithmic spiral may provide a similar exponential narrowing of one or more dimensions of the channels, the area between the walls separating them, and a similar stable change in the parameters of the processes occurring in these channels if the parameters of the processes also have an exponential dependence, such as the dependence of saturation pressure on temperature.

For embodiments with channels forming a logarithmic spiral, the channels of the hot and cold flow sections may be adjacent to each other in a one-to-one correspondence with a common interface between them. If the entry points or inlets of the hot flow channels are at the periphery or outermost section of the logarithmic spiral, the surface area of the common interface in the hot flow channels may taper exponentially from the inlets of the hot flow channels to their outlets which may be located centrally, coaxial to the axis or axes of the spiral. Similarly, if the entry points or inlets of the cold flow channels are centrally located in the spiral, the surface area of the common interface in the cold flow channels may expand at the inverse of the exponential rate of the hot flow channel surface area from the inlets of the cold flow channels to the outlets of the cold flow channels located at the periphery of the spiral.

Other heat exchangers have been configured to form a logarithmic spiral such as for example, in U.S. Pat. No. 7,287,580 B2 (by Harman). It should be noted that the Harman patent includes vanes for heat transfer between the active surface and the fluid and doesn't disclose latent energy exchange between two fluids by a combination of a phase change and a reversing phase change, a two-channel design, or the dependency of the spiral shape on the process parameters as discussed herein.

In some preferred embodiments of the present invention, a hot channel width and therefore the radius of the channel centerline may reduce at an exponential rate from an entrance with theta (θ), the rotational angular measurement of the spiral's length in polar coordinates. Similarly, a cold channel width and radius of the channel centerline may reduce at an exponential rate from an exit with θ.

In some preferred embodiments of the present invention, the hot and cold flow channels may be adjacent to each other throughout the entire lengths of their respective channels, although the fluid may flow in opposite directions for each such that the entry of the hot flow may be juxtaposed or adjacent to the exit of the cold flow. The surface area between any two locations 1 and 2, ΔA(1,2), along the channels may be expressed as:

$$\Delta A(1,2)=C(e^{bl(1)}-e^{bl(2)}) \quad (1)$$

where C and b are constants that depend on the geometry of the two channels, and l(1) and l(2) are coordinates of channel cross sections 1 and 2 as measured from one end of the latent energy exchanger's channels. For the logarithmic spiral geometry, l may be measured angularly by a change in θ (in the polar or cylindrical coordinate system) as measured from the inlet of the hot flow channel and the outlet of the cold flow channel.

At saturation, the change in partial vapor pressure, Pvsat, between locations 1 and 2 may be proportional to the interface surface area $\Delta A_{if}$ between locations 1 and 2 as follows:

$$\mathrm{Pvsat}(1)-\mathrm{Pvsat}(2)=\Delta\mathrm{Pvsat}(1,2)=k\Delta A_{if} \quad (2)$$

where k is a constant similarly dependent on geometry, interface energy transfer capacity and density, and initial flow conditions. If equation (2) is true for any small change in the interface area, the pressure in any cross section 1 will depend exponentially on the location of this cross section:

$$\mathrm{Pvsat}(1)=k(e^{bl(1)}) \quad (2a)$$

Under these conditions, the temperature of the fluid flow may vary almost linearly along the length of the channel for both hot and cold flow channels. Latent energy may be transferred along the common interface surface of the two channels in such a manner that in each section of the channels, the relationship between pressure and temperature in the state of saturation may be provided in accordance with Clausius-Clapeyron equation for air containing water vapor (see for example, the derivation for the ideal gas approximation at low temperatures in: https://wn.wikipedia.org/wiki/Clausius%E2%80%93Clapeyron_relation)

$$\frac{Pvsat(1)}{Pvsat(2)} = e^{\frac{L}{Rv}\left(\frac{1}{T(2)} - \frac{1}{T(1)}\right)} \tag{3}$$

where L is the specific heat of water, Rv is the gas constant of water vapor, and T(2) and T(1) are the temperatures at locations 2 and 1 respectively.

If equations (1), (2), and (3a) are combined, the following relationship can be seen:

$$b(l(1) - I(2)) = D\left(\frac{1}{T(2)} - \frac{1}{T(1)}\right) \tag{4}$$

where b is a constant and D is the ratio of L to Rv from equation (3).

As is known for the temperature range from 293K to 363K, the longest probable temperature interval for exhaust cooling during vapor condensation, and D≈5265 K, the following approximation holds with an accuracy less than 1%.

$$D\left(\frac{1}{T(2)} - \frac{1}{T(1)}\right) \cong E(T(1) - T(2)) \tag{5}$$

where E is a constant.

Therefore, $$\frac{(T(1) - T(2))}{l(1, 2)} = \text{Constant} \tag{6}$$

Equation (6) shows that for any two points that are spaced a given distance apart in a channel, the change in temperature between those two points may be approximately or nearly constant.

For both linear and curved embodiments of the present invention, the amount of latent energy transfer ΔQlat between any two cross sections in the channels depends on the heat transfer area ΔAht, which is in the interface section $A_{if}$ or is inserted through it:

$$\Delta Qlat = H \times \Delta Aht = L \times \Delta mv \tag{7}$$

where H is the specific heat transfer per unit of heat transfer area, which depends on the heat transfer conditions, flow rate, surface thermal properties, and changes in temperature T with the channel length. L is the specific latent heat of the saturated fluid, and Δmv is the change in mass flow rate of the vapor between the two cross sections.

The humidity ratio of an air-vapor mixture can be expressed in terms of the ratio of dry air $m_d$ to water vapor gas $m_v$, the water vapor gas constant F, saturation vapor pressure Pvs, and total vapor pressure Ptot based on the Ideal Gas Law:

$$m_v = m_d \varepsilon \frac{Pvs}{(Ptot - Pvs)} \tag{8a}$$

and $$\Delta m_v = m_d \varepsilon \left(\frac{Pvs1}{(Ptot - Pvs1)} - \frac{Pvs2}{(Ptot - Pvs2)}\right) = m_d \varepsilon \left(\frac{Ptot(Pvs1 - Pvs2)}{(Ptot - Pvs1)(Ptot - Pvs1)}\right) \tag{8b}$$

From (7) (8b):

$$\Delta Aht = \frac{L}{H} m_d \varepsilon \left(\frac{Ptot}{(Ptot - Pvs1)(Ptot - Pvs1)}\right)(Pvs1 - Pvs2) \tag{9}$$

and from (2) and (9)

$$\Delta Aht = \frac{L}{H} m_d \varepsilon \left(\frac{Ptot}{(Ptot - Pvs1)(Ptot - Pvs1)}\right) k \Delta A_{if} = C1 f(Pv) \Delta A_{if} \tag{9a}$$

Therefore, the eat transfer surface area may be approximate as a function of the partial vapor pressure and the interface surface are between two locations along a channel.

With a channel configuration such that the width and possibly cross sections of the cold and hot flow channel vary in accordance with the above conditions, latent energy transfer may be stable along the length of the channel, and there may be an approximately linear temperature distribution along the channel with a minimum temperature difference between the hot and cold flows. Sensible energy transfer may also occur, but at a much smaller percentage of the total energy transfer along the channel.

Figure 2B:
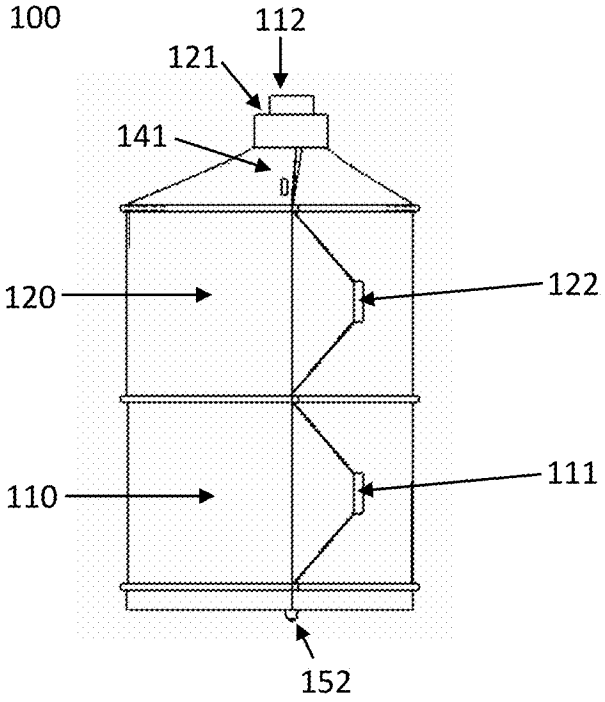
FIGS. 2*a* and 2*b* show an isometric view and external views of a latent energy exchanger according to an embodiment of the invention.
Figure 2A:
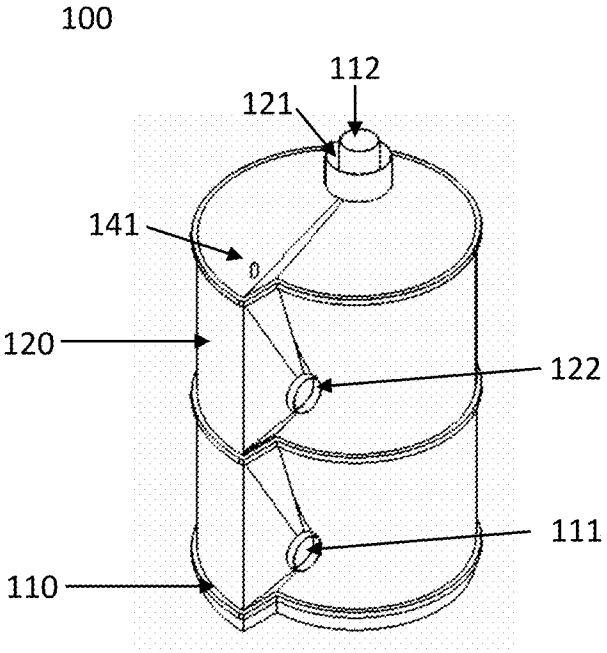

FIG. 2 illustrates a preferred embodiment of a latent energy exchanger 100 having a logarithmic spiral geometry in accordance with the present invention. FIG. 2*a* provides an isometric view and FIG. 2*b* shows an external side view of latent energy exchanger 100. The perspective of FIG. 2*a* is from above at an angular elevation from the top and outside of latent energy exchanger 100. For this embodiment, latent energy exchanger 100 comprises hot flow section 110, hot flow inlet 111, hot flow outlet 112, cold flow section 120, cold flow inlet 121, cold flow outlet 122, cold water inlet 141, and warm condensate outlet 152. Latent energy exchanger 100 may be configured with both hot and cold flow sections having congruent or similar logarithmic spiral geometry with hot flow section 110 below and adjacent to cold flow section 120, although other configurations such as for example, side by side or with coaxial sections may also be possible. Furthermore, hot flow section 110 and cold flow section 120 may comprise a quantity of hot flow channels and cold flow channels respectively such that the quantity of hot flow channels and the quantity cold flow channels may be equal. For example, there may be one hot flow channel and one corresponding cold flow channel adjacent to each other.

In the embodiment of FIG. 2, a hot flow comprising wet exhaust may enter or be injected into hot flow section 110 tangentially at hot flow inlet 111 located at or near the periphery, i.e., at the radially outermost part of hot flow section 110. The hot flow may move radially inward following the logarithmic shape of the hot flow channel with its partial vapor pressure and temperature lowering to maintain a saturated condition as energy is being transferred out along the angular length of the channel. The hot flow may exit latent energy exchanger 100 at centrally located hot flow outlet 112 which may be configured to remove the cooled hot flow vertically in an upward direction possibly along a central axis of latent energy exchanger 100, although the invention is not limited in this respect.

Because latent energy exchanger 100 operates with counterflowing hot and cold sections, cold flow inlet 121 of cold flow section 120 may be centrally located adjacent to or coaxial with hot flow outlet 112. The cold flow entering latent energy exchanger 100 may comprise air at an ambient temperature or other suitable gaseous mixture capable of absorbing moisture through evaporation. In some embodiments, cold flow section 120 may be adjacent to and above hot flow section 110 such that there may be a common interface for energy exchanger. Alternatively, a central plate or plates may separate the hot and cold flow sections thereby forming the common interface. The cold flow may move radially outward following the logarithmic spiral shape of the cold flow channel with the combination of partial vapor pressure and temperature at saturation increasing as heat is being transferred in along the angular length of the channel. The cold flow may exit cold flow section 120 from cold flow outlet 122 located at an outermost radial end of the spiral channel of cold flow section 120. In some embodiments, cold flow outlet 122 and hot flow inlet 111 may be in close proximity, i.e. juxtaposed, at the periphery of latent energy exchanger 100, although the invention is not limited in this respect. Other suitable geometries are also possible.

In some preferred embodiments, cold water may be distributed into cold flow section 120 from cold water inlet 141 to enable energy transfer from the wet exhaust through the evaporation of water in cold flow section 120 as a reverse phase change process thereby humidifying the cold flow. Additionally, latent energy exchanger 100 may comprise a warm condensate outlet 152 to allow any water vapor that may condense inside hot flow section 110 to be removed from latent energy exchanger 100 as it develops.

Figure 3B:
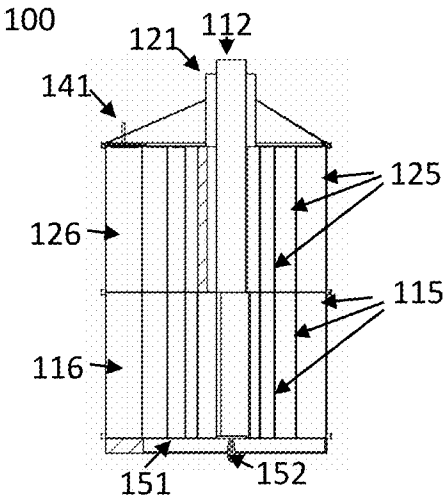
FIGS. 3*a*, 3*b*, and 3*c* show vertical cross-sectional views of a latent energy exchanger according to an embodiment of the invention.
Figure 3C:
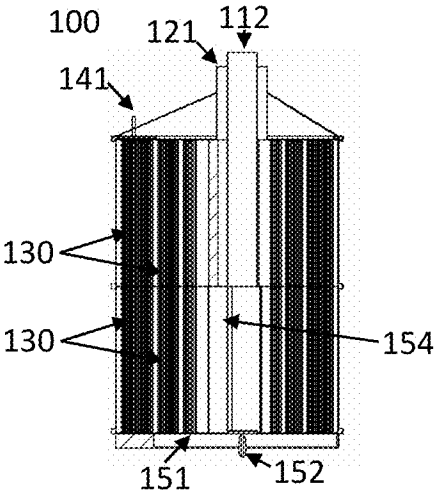
Figure 3A:
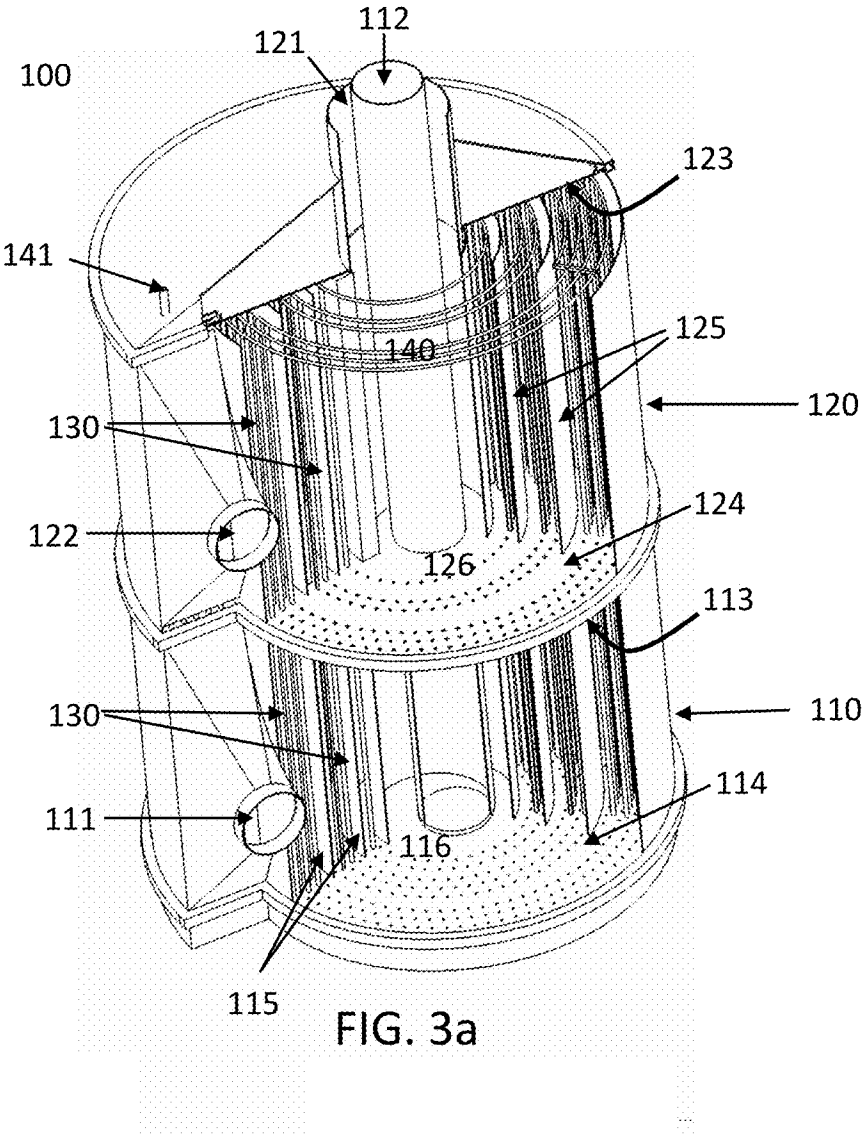
Figure 4B:
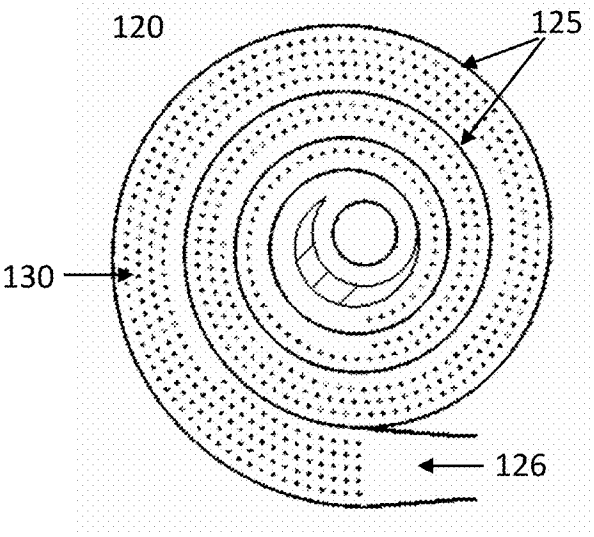
FIGS. 4*a* and 4*b* show horizontal cross-sectional views of two sections of a latent energy exchanger according to an embodiment of the invention.
Figure 4A:
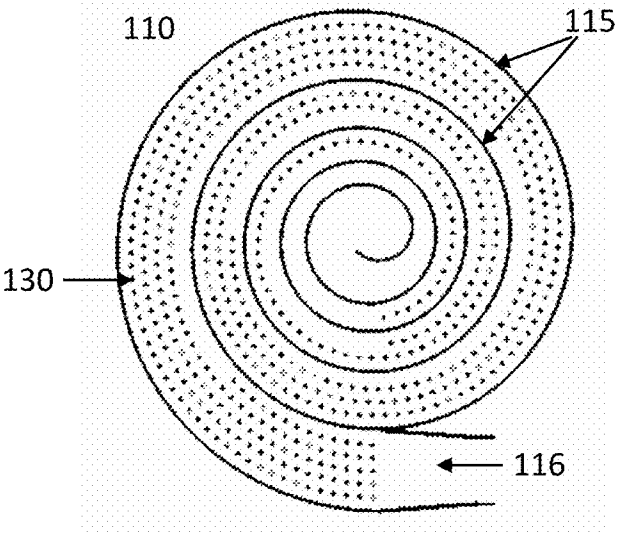

FIGS. 3*a*, 3*b*, and 3*c* depict an isometric cutout view, a first vertical cross section, and second vertical cross section of latent energy exchanger 100. The perspective of FIG. 3*a* is from above at an angular elevation from the top and outside of latent energy exchanger 100. FIGS. 4*a* and 4*b* depict horizontal cross-sectional views of hot flow section 110 and cold flow section 120 respectively. For the embodiment of FIGS. 3 and 4, the spiral channels of latent energy exchanger 100 are 6π radians or 1080° in total angular length, Other angular lengths are possible and may depend, for example, on the initial conditions of the wet exhaust, the cold flow, the dimensions and material composition of latent energy exchanger 100, and the desired output of latent energy exchanger 100 although the invention is not limited in this respect. Other characteristics relevant to the efficient operation of latent energy exchanger 100 may also influence the angular length of the channels.

Hot flow section 110 may further comprise hot flow section top plate 113, hot flow section bottom plate 114, hot flow section side walls 115, which together may form the outside of hot flow channel 116. For these embodiments, hot flow channel 116 may have a rectangular cross section, although the invention is not limited in this respect. Other cross sections for hot flow channels such as, for example, circular or oval are also possible. An advantage of a rectangular cross section for hot flow channel 116 is that sections of hot flow channel 116 are adjacent to each other and may provide for a more compact design for latent energy exchanger 100 with lower losses of heat to the outside environment.

As mentioned above, hot flow channel 116 may be configured to form a logarithmic spiral with the width of the hot flow channel 116 and the distance of hot flow section side walls 115 from a vertical central axis of latent energy exchanger 100 both decreasing with increasing angular distance along the channel length from hot flow inlet 111. Such a configuration is shown in FIG. 4*a* with the analogous logarithmic spiral configuration for cold flow channel 126 shown in FIG. 4*b*. The radius r of a hot flow section side wall 115 at a given angular coordinate 0 may be expressed as:

$$r=ae^{b\theta} \tag{10}$$

where a is the outer radius of the hot flow section side wall 115 at hot flow channel outlet 122 where θ is zero and the value for b is discussed subsequently below. The same relationship may be true for the radius of the cold flow section side wall 125 where θ is zero at cold flow inlet 121.

The values of these constants and the corresponding angular length of channels 116 and 126 depend on initial temperature, pressure, material properties, mass flow conditions of latent energy exchanger 100, and a desired fixed temperature difference between the two sections as well as possibly other characteristics relevant to the operation of latent energy exchanger 100.

In angular coordinates, the width W of hot flow channel 116 *w* may then be determined to be:

$$W=r(\theta+2\pi)-r(\theta)=ae^{b\theta}(e^{b2\pi}-1)=r(\theta)(e^{b2\pi}-1) \tag{11}$$

The interface area for a logarithmic spiral channel $\Delta A_{if}$ is the area between the curves and channel cross sections at angles θ1 and θ2 with widths W(θ1) and W(θ2):

$$\Delta A_{if} = \frac{r(\theta 1)^2 - r(\theta 2)^2}{4b}\left(e^{2b2\pi} - 1\right) \tag{12}$$

Rearranging equations (11) and (12):

$$W2^2 - W1^2 = \Delta A_{if}\left(\frac{4b\left(\left(e^{b2\pi} - 1\right)^2\right)}{\left(e^{2b2\pi} - 1\right)}\right) = C_2\Delta A_{if} \tag{13}$$

where $C_2$ is a function of b and is a constant.

With the input flow conditions known, combining equations (2) and (13) results in the following:

$$\mathrm{Pvsat}(\theta)=KW(\theta)^2 \tag{14}$$

where K is a constant expressing the relationship between the geometrical parameters of the channel and the physical parameters of the flow in the channel. This relationship between the vapor partial pressure and channel width is a feature of the logarithmic spiral embodiment of the present invention as derived herein by designing the channel geometry to match the initial flow conditions and heat transfer properties of the materials and surfaces used in common interface.

For the logarithmic spiral geometry, equation (4) can be written as follows:

$$2b(\theta 1 - \theta 2) = \frac{L}{Rv}\left(\frac{1}{T2} - \frac{1}{T1}\right) \tag{13}$$

where θ1-θ2 is the angular length between cross sections 1 and 2 and T1 and T2 are the flow temperatures in these respective cross sections. The constant b is the polar slope angle as is known for a logarithmic spiral and can be defined from equation (13) if cross sections 1 and 2 are the initial and final cross sections of the channel, given the most probable set of initial and final temperatures of one of their flows and a given angle interval:

$$b = \frac{\frac{L}{Rv}\left(\frac{1}{T2} - \frac{1}{T1}\right)}{2(\theta 1 - \theta 2)} \tag{13a}$$

Cold flow section 120 may further comprise cold flow section top plate 123, bottom plate 124 of cold flow section 120, and cold flow channel side walls 125, which may form the outside of cold flow channel 126 that may also have a rectangular cross section like hot flow channel 116. Other shapes for the cross section of cold flow channel 126 are also possible. In some embodiments, the thickness of cold flow channel walls 125 may be different than the thickness of hot flow channel walls 115 as determined by the initial flow conditions and material properties of the common interface. In the present embodiment, the radius of cold flow channel walls 125 and the width of cold flow channel 126 are the same as for hot flow channel 116 determined by equations (10) and (11) at any distance measured from cold flow inlet 121, located at the central axis of latent energy exchanger 100 and directly above hot flow outlet 112. This configuration is shown in FIG. 4*b*. However, the heights of hot flow channel 116 and cold flow channel 126 may vary to match the initial conditions of the hot and cold flows and the energy transfer characteristics of latent energy exchanger 100.

Figure 5B:
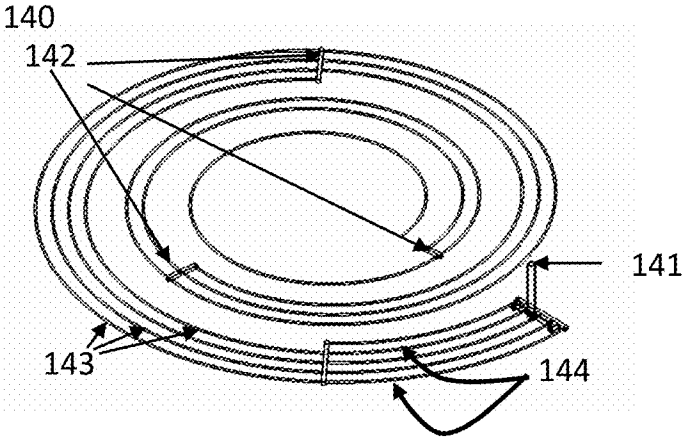
FIGS. 5*a*, 5*b*, and 5*c* show views of heat pipes, a water distribution system, and a water removal system according to an embodiment of the invention.
Figure 5C:
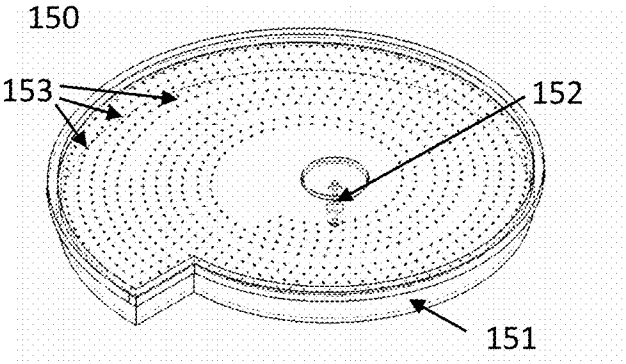
Figure 5A:
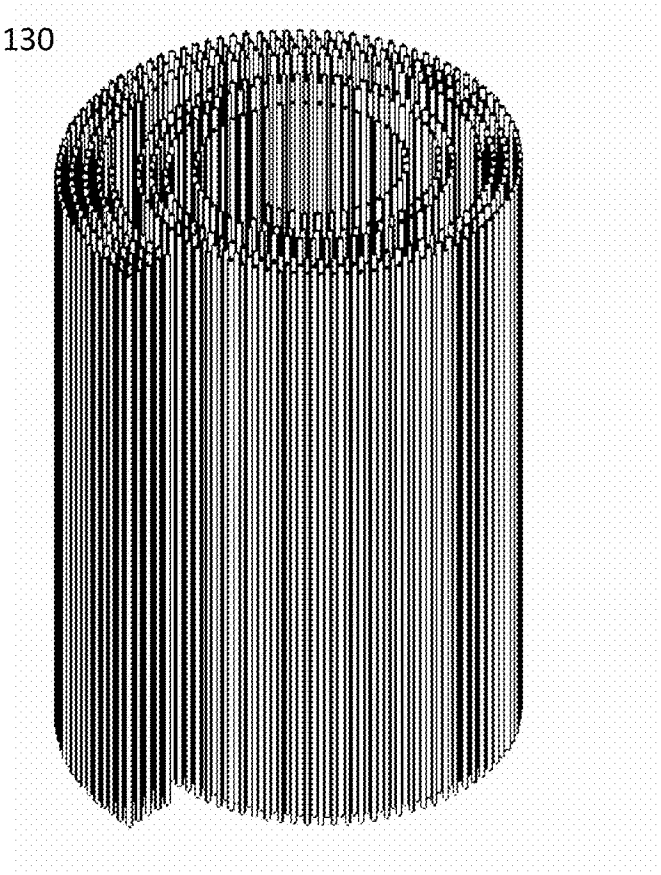

To enhance the latent energy transfer capacity of latent energy exchanger 100, some preferred embodiments may include heat pipes 130, water distribution system 140, and water collection system 150, as shown in FIG. 3 with each shown in the isolated isometric views of FIGS. 5*a*, 5*b*, and 5*c* respectively, although not all elements are visible in each figure. Heat pipes 130 may transfer heat from hot flow section 110 to cold flow section 120. They may be linear in shape and may protrude or extend substantially into both hot flow channel 116 and cold flow channel 126 through hot flow section top plate 113 and cold flow section bottom plate 124. These combined elements may serve as a common interface for energy transfer. As is known, each of heat pipes 130 may comprise an evaporation section in which evaporation occurs when exposed to a warmer external temperature, a condensation section in which condensation occurs when exposed to a cooler external temperature, and an adiabatic section between them.

The extent to which heat pipes 130 protrude into the channels may depend on the heat transfer properties of heat pipes 130, the geometry of latent energy exchanger 100, operating conditions, and possibly other factors. As shown in FIG. 3, heat pipes 130 extend nearly the entire height of the hot and cold flow channels. Other devices such as thermosiphons for example, in which heat transfer is accomplished in a substantially sealed cavity containing a liquid, heat being absorbed in one portion of the cavity by vaporization of the liquid and released in a second portion of the cavity by condensation of the vapor with the condensed vapor being recirculated to the first portion of the cavity for subsequent vaporization are also possible. In some preferred embodiments such as depicted in FIGS. 2-5 the interface between hot flow section 110 and cold flow section 120 or hot flow section top plate 113 and cold flow section bottom plate 124 may be insulated. For these embodiments, all of the energy exchanged may be transferred via heat pipes 130. Alternatively, hot flow section top plate 113 and cold flow section bottom plate 124 may be thermally conductive, thereby augmenting, eliminating or reducing the need for heat pipes 130.

The density, number, and locations of heat pipes 130 may be determined by the condensation and evaporation process distribution with the interface surface conditions, condensate/water film limitation for the heat pipes' 130 surface, the thermal power of heat pipes 130, as well as other parameters. The density of heat pipes 130, i.e., the number of heat pipes 130 per unit of common interface surface area and the number of heat pipes per unit of angular distance may taper or reduce along the length of hot flow channels 116 such that the heat transfer may be evenly distributed per unit of the heat transfer surfaces of heat pipes 130. For the present embodiment, the heat pipe density decreases with decreasing radius, i.e increases with angular distance as measured from hot flow channel outlet 112. In some embodiments, there may be multiple rows of heat pipes protruding into both channels with the number of rows decreasing with decreasing channel radius at one or more locations along the hot and cold flow channels. This arrangement can be seen more clearly in the cross sections of FIG. 4. Such a configuration of heat pipes 130 may enable latent energy exchanger 100 to operate with a nearly constant temperature difference between hot and cold flows at a hot flow vapor partial pressure such that latent energy can be extracted from the hot flow throughout the entire length of hot flow channel 116 as well as with a nearly constant ratio of latent energy exchange to interface surface area along the length of the hot and cold flow channels.

Water distribution system 140 may act to distribute water throughout cold flow channel 126 to enable evaporative latent energy transfer in cold flow channel 126 in conjunction with heat pipes 130 by applying water close to the condensation sections of heat pipes 130. Water distribution system 140 may comprise water inlet 141, water redistributors 142, water pipes 143, and water pipe orifices 144. As can be seen in FIG. 4, water or other suitable cold liquid may enter water distribution system 140 through water inlet 141 at the outermost part of cold flow channel 126. The water or other suitable liquid may be distributed among water pipes 143 which may run in parallel along the length of cold flow channel 126 and may be located directly above the rows of heat pipes 130. As the number of rows of heat pipes 130 decreases, the number of water pipes 143 may decrease in parallel with the rows of heat pipes 130. Water redistributors 132 may redistribute the water from a larger number of parallel water pipes 143 to a smaller number according to the decrease in channel width at one or more locations along cold flow channel 126. In the embodiment of FIG. 4, there are initially six rows of water pipes 143 that reduce in one row decrements to a single row of water pipes 143 by the end of cold flow channel 116 with corresponding rows of heat pipes 130. Water pipe orifices 144 may be super positioned above heat pipes 130 to allow water from water pipes 143 to flow onto and over heat pipes 130. The condensation segments of heat pipes 130 extending into cold flow channel 116 may be warmer than the cold flow and cold water flowing in cold water pipes 143. Contact between the water and heat pipes 130 may result in evaporation of the water thereby transferring latent energy in a phase change by adding moisture from the evaporated water to the cold flowing air or other gaseous mixture. The latent energy transfer by evaporation of the water may cause condensation of a working fluid inside heat pipes 130 which in turn may return to hot flow section 110.

A counterpart to this evaporation may occur in hot flow channel 116 at the evaporation sections of heat pipes 130 entering hot flow channel 116. Because the temperature of the segments of heat pipes 130 entering hot flow channel 116 may be cooler than the hot flow inside hot flow channel 116, condensation may form on heat pipes 130. This condensation may be a second transfer of latent energy from the hot flow by evaporation of the working fluid inside heat pipes 130 which may return to cold flow section 120.

Water removal system 150 may function to capture residual water in the form of condensate in hot flow section 110 and residual water that may not have evaporated in cold flow section 120. Water removal system 150 may comprise water collection section 151, warm condensate outlet 152, water removal orifices 153, and cold flow section drain 154. Water collection section 151 may collect condensate from hot flow section 110 immediately after its formation through water removal orifices 153 located in hot flow section bottom plate 114 for removal from latent energy exchanger 100 through water condensate outlet 152. The number and distribution of water removal orifices 153 may be determined by the amount of condensate formed along hot flow channel 116 so as not to impede heat transfer processes in hot flow section 110. One or more cold flow section drains 154 may remove any residual water that has not evaporated in cold flow channel 126 and transfer it to water collection section 151 as shown in FIG. 5.

The condensation in hot flow section 110, the vaporization in cold flow section 120, and the condensation and vaporization in heat pipes 130 are a total of potentially four latent energy transfer modes that may operate simultaneously in latent energy exchanger 100 for a highly efficient extraction of heat and moisture from a wet exhaust or other hot flow. The exponential reduction in both hot and cold flow channel cross sections may also contribute to enabling continuous latent energy transfer along most, if not all the length of both channels while maintaining a consistent and small temperature difference between the two channels.

A representative embodiment of heat exchanger 100 having logarithmic spiral channels in accordance with the above description may have the design parameters shown in the following table although other configurations and parameters are also possible:

| Parameter | Hot channel | Cold channel |
|---|---|---|
| Channel width entrance/exit, m | 0.25/0.085 | 0.085/0.25 |
| Channel width formula | $ae^{b\theta}(e^{b2\pi}-1)$ | $ae^{b\theta}(e^{b2\pi}-1)$ |
| Channel height, m | 1 | 1 |
| Channel rotation angle, rad | $6\pi < \theta < 0$ | $0 < \theta < 6\pi$ |
| Mass flow rate for air/vapor mixture at entrance, kg/s | 0.444 | 0.423 |
| Vapor concentration at entrance, kg/kg mixture | 0.25 | 0.019 |
| Flow temperature at entrance, K | 346 | 298 |
| Heat pipe number/power(W) | 600/414.5 | |

Figure 6:
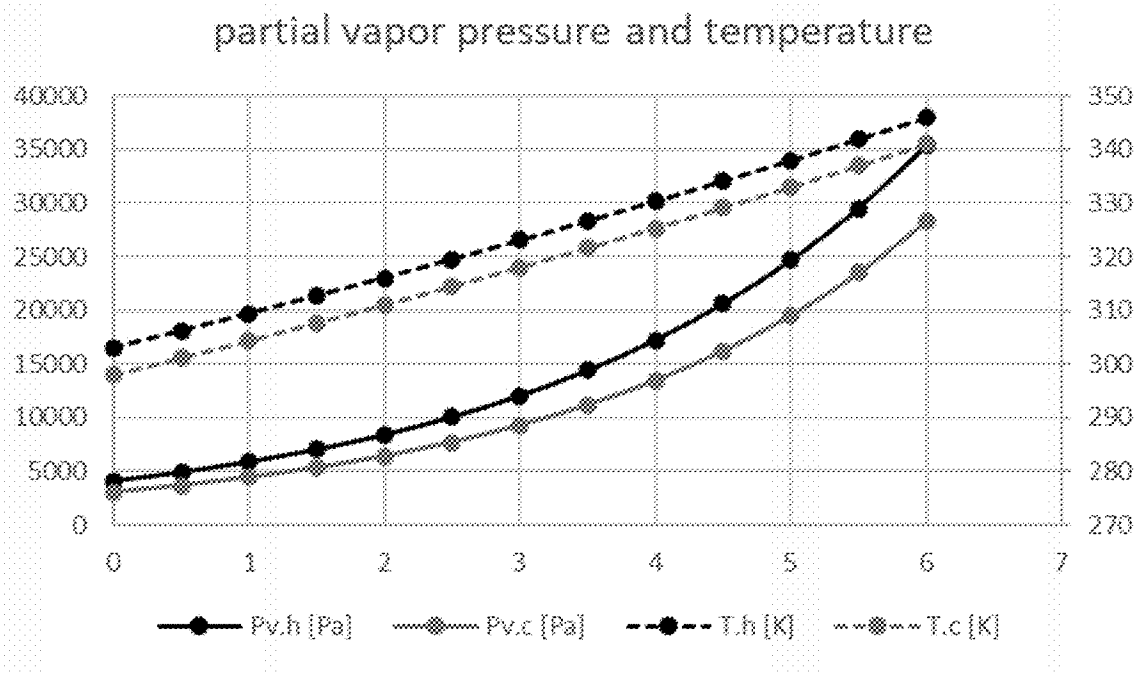
FIG. 6 is a graph illustrating the relationships for partial vapor pressures and temperatures versus position in a latent energy exchanger along the length of channels according to an embodiment of the invention.

Reference is now made to FIG. 6 which illustrates how the vapor partial pressure and temperature for both hot and cold flow channels may vary along the length of spiral channels from the entrance of the cold flow channel and the exit of the hot flow channel for adjacent hot and cold flow channels according to the preferred embodiment described above with hot and cold flow channels having a rectangular cross section with a fixed height and exponentially varying width. The units of pressure are pascals as indicated on the left axis, while temperature is shown in Kelvin on the right axis. In the illustrative embodiment of FIG. 6, the latent energy exchanger is configured to have spiral designs for hot and cold flow channels, and the measurement for position along the channel is angular in units of $\pi$ radians such that the full length of the channel is $6\pi$ radians. The line marked as Pv.h is the partial vapor pressure of the hot flow, while the line marked as Pv.c is the partial vapor pressure of the cold flow. T.h and T.c indicate hot and cold flow channel temperatures respectively. With an appropriate selection of constants as shown above, the temperature variation may be approximately linear with a deviation from a linear relation of 1% or less over the length of the channels, and the temperature difference between hot and cold flow channels may be approximately or substantially constant with a variation of less than 0.5% while the partial vapor pressure in both channels may vary exponentially and may be maintained at or near saturation according to the Clausius-Clapeyron equation such that condensation may take place in the hot channel and evaporation may take place in the cold channel.

Figure 7:
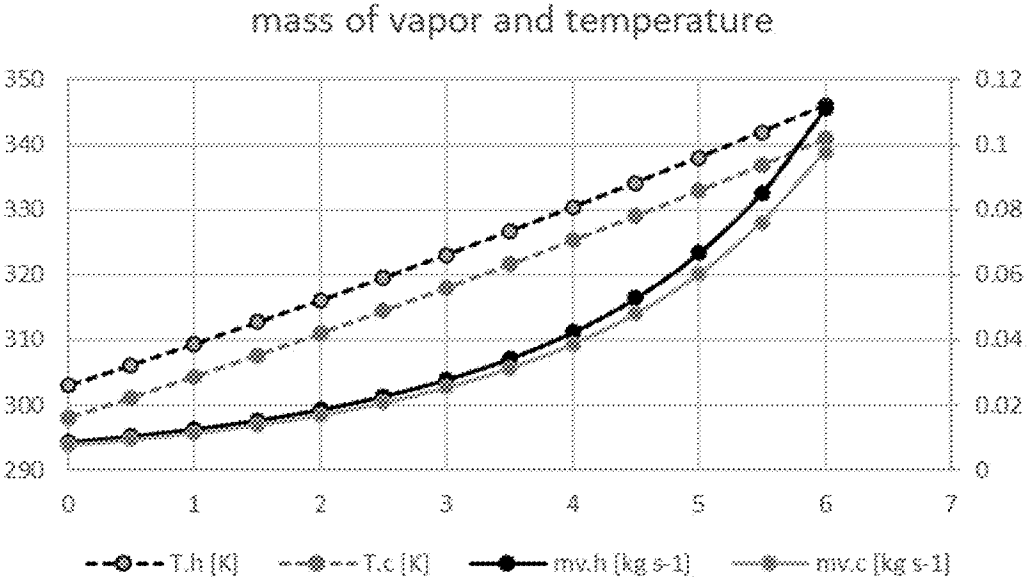
FIG. 7 is a graph illustrating the relationships of vapor masses and temperatures versus position along the length of channels in a latent energy exchanger according to an embodiment of the invention.

FIG. 7 illustrates how vapor mass flow and temperature may vary along the same channels as those for FIG. 6 with units of mass flow shown on the right axis in kilograms per second (kg/s). Vapor mass flow rates for hot and cold flow channels are indicated by mv.h and mv.c respectively. As can be seen, vapor mass flow rates also may increase almost exponentially along the length of the channel from the inlet of the cold flow channel.

Figure 8:
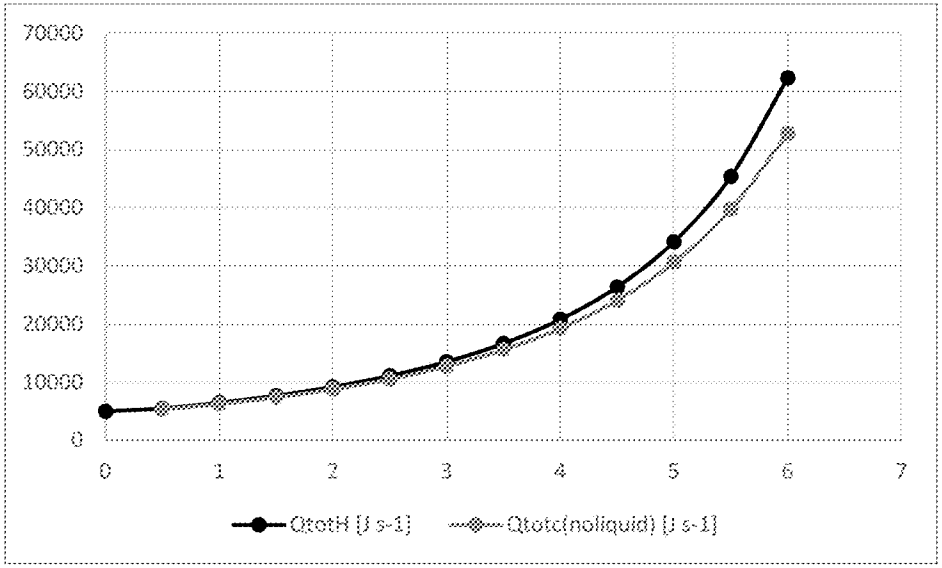
FIG. 8 is a graph illustrating the total heat being transferred from hot and into cold flow channels as a function of position along the length of channels in a latent energy exchanger according to an embodiment of the invention.

With these conditions, the total heat transfer along the channel can be calculated as shown in FIG. 8 with the vertical scale in Joules per second. The total heat transfer includes both latent and sensible heat transfer. As the temperature decreases along hot flow channel 116, sensible heat is transferred out of the non-condensable portion of the gas mixture at a constant rate because the total mass of the non-condensable portion of the mixture doesn't change, while the sensible heat transfer from the vapor portion decreases with the decreasing mass of the vapor portion of the mixture. The reverse absorption of sensible heat occurs in cold flow channel 126 for the non-condensable and vapor portions of the cold flow respectively.

The horizontal line is measured in radians as measured from the beginning of the hot flow channel. The line represented by Qtoth is the heat transferred by the hot channel, while Qtotc is the heat absorbed by the cold channel. As can be seen, the heat transfer may be substantially balanced between the two channels along the length of the channel with only a 5% difference between Qtoth and Qtotc along the length of the channel being the latent energy lost during the exchange.

Figure 9:
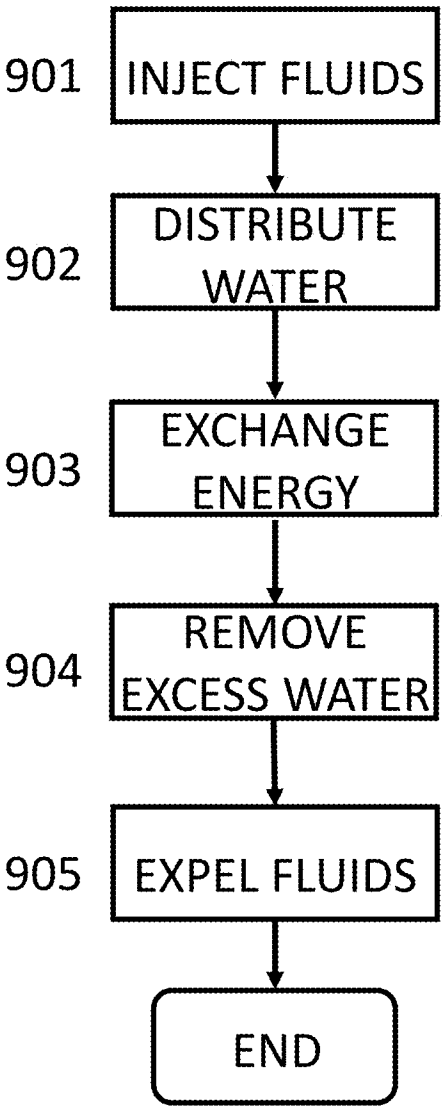
FIG. 9 is a flowchart of a method for exchanging latent energy according to an embodiment of the invention.

Reference is now made to FIG. 9 which shows a method for exchanging energy between a wet exhaust and a cold flow according to a preferred embodiment of the present invention. Embodiments of the method may be used by, or implemented by, for example, latent energy exchanger 100 of FIGS. 2 through 5.

In operation 901, a wet exhaust may be injected or directed into hot flow inlet 111 of hot flow section 110 such that the wet exhaust may move into and through hot flow channel 116, and a cold flow may be injected or directed into inlet 121 of cold flow section 120 such that the cold flow may move into and through cold flow channel 126 in the opposite direction of the wet exhaust relative to hot flow inlet 111 and cold flow outlet 122.

To facilitate the absorption of energy in cold flow section 120, in operation 902 water or other suitable liquid may be distributed by water distribution system 140 throughout the cold flow channel 126 for an evaporative process to occur when the water may come into contact with the cold flow side surface of the common interface between the hot and cold flow sections. In some preferred embodiments such as shown in FIGS. 2-5, that cold flow side interface surface may take the form of heat pipes 130.

As the wet exhaust moves through hot flow channel 116 and the cold flow moves through cold flow channel 126, latent energy may be extracted from the wet exhaust in the form of condensation and absorbed as latent energy in the form of evaporation into the cold flow in cold flow channel 126 in operation 903.

The energy may be transferred between the channels through the common interface between them, such as for example via heat pipes 130, along substantially the operating lengths of both channels.

In operation 904, the liquid water produced by the condensation in hot flow channel 116 and any excess water that is not evaporated in cold flow channel 126 may be collected and removed from latent energy exchanger 100 by water collection system 150. Removing this water may avoid any buildup of liquid in both hot and cold sections, thereby enhancing the performance of latent energy exchanger 100.

Once the cooled and dehumidified wet exhaust has reached the end of hot flow channel 116 and the heated and humidified cold flow has reached the end of cold flow channel 126, both flows may be expelled from their respective channels in operation 905 with the temperature of wet exhaust at hot flow outlet 112 within a few degrees Kelvin of the temperature of the cold flow entering cold flow inlet 121. Similarly, temperature of the cold flow at cold flow outlet 122 may be within a few degrees Kelvin of the temperature of the wet exhaust entering hot flow inlet 111. These small temperature differences between the adjacent entry and exit points of the two sections may be maintained throughout the lengths of both sets of channels because of the exponentially varying common surface area and channel cross sections as described herein that may control the temperatures and vapor pressures of both sections. This control may enable latent energy exchange along substantially the operating length of both sets of channels.

Other operations or series of operations may be used.

While the invention has been described with respect to a limited number of embodiments, it will be appreciated that many variations, modifications, and other applications of the invention may be made. Embodiments of the present invention may include other apparatuses for performing the operations herein. Such apparatuses may integrate the elements discussed or may comprise alternative components to carry out the same purpose. It will be appreciated by persons skilled in the art that the appended claims are intended to cover all such modifications and changes as fall within the true spirit of the invention.

What is claimed is:

1. An energy exchanger for exchanging energy between a hot flow and a cold flow, the energy exchanger comprising:

a hot flow section comprising a quantity of hot flow channels, each of the hot flow channels having a variable cross section and comprising a hot flow inlet, a hot flow outlet, and a passage having a length for the hot flow to move from the hot flow inlet to the hot flow outlet;

a cold flow section comprising a quantity of cold flow channels, each of the cold flow channels having a variable cross section and comprising a cold flow inlet, a cold flow outlet, and a passage having a length for the cold flow to move from the cold flow inlet to the cold flow outlet, the quantity of cold flow channels being the same as the quantity of hot flow channels, the inlets of the cold flow channels juxtaposed to the outlets of hot flow channels, the outlets of the cold flow channels juxtaposed to the inlets of the hot flow channels such that the hot flow and the cold flow move in opposing directions through the energy exchanger;

a liquid distribution system for distributing a liquid into each of the cold flow channels;

a common interface between each hot flow channel and a corresponding cold flow channel, the common interface having a varying surface area in each of the hot flow channels and each of the cold flow channels, the varying surface areas adapted for exchanging latent energy released through condensation in the hot flow section and absorbed through evaporation in the cold flow section, the varying surface areas tapering at an exponential rate from the inlets of the hot flow channels to the outlets of the hot flow channels and expanding at an inverse of the hot flow channel exponential tapering rate from the inlets of the cold flow channels to the outlets of the cold flow channels;

wherein a combination of the varying surface areas of the common interface, the variations of the cross sections of the hot flow channels, and the variations of the cross sections of the cold flow channels maintains the hot flow at saturation, reduces a vapor partial pressure of the hot flow in proportion to the tapering of the varying surface areas in the hot flow channels, reduces a temperature of the hot flow linearly along the length of the hot flow channels, maintains the cold flow at saturation, increases a vapor partial pressure of the cold flow in proportion to the expansion of the varying surface areas in the cold flow channels, and increases a temperature of the cold flow linearly along the length of the cold flow channels such that there is constant temperature difference between the hot flow and the cold flow at any distance as measured from the inlets of the hot flow channels and as measured from the outlets of the corresponding cold flow channels.

2. The system of claim 1 wherein the common interface is comprised of a heat transfer surface in each of the hot flow channels and a corresponding heat transfer surface in each of the cold flow channels, each heat transfer surface in the hot flow channels is connected thermally to its corresponding heat transfer surface in the cold flow channels.

3. The energy exchanger of claim 2 wherein the exponential variations of the common interface surface areas are dependent on a set of initial properties of the hot flow, the cold flow, and the liquid distributed by the liquid distribution system; a heat transfer capacity of the heat transfer surfaces in the hot flow channels; and a heat transfer capacity of the heat transfer surfaces in the cold flow channels.

4. The system of claim 3 further comprising a liquid removal system for removing condensate from the hot flow section and residual liquid from the cold flow section.

5. The system of claim 4 wherein the liquid distribution system comprises one or more pipes for distributing the liquid close to the heat transfer surfaces in the cold flow channels.

6. The system of claim 5 wherein at least one dimension of the variable cross section of each hot flow channel forms a hot flow logarithmic spiral along the length of the hot flow channel and at least one dimension of the variable cross section of each cold flow channel forms a cold flow logarithmic spiral along the length of the cold flow channel such that the hot flow and cold flow logarithmic spirals are congruent.

7. The system of claim 6 wherein each of the hot flow channels has a centerline and a width, the centerline and the width of the hot flow channels decreasing exponentially with an angular distance as measured from the inlets of the hot flow channels, the inlets of the hot flow channels located at a periphery of the hot flow logarithmic spiral and the outlets of the hot flow channels located centrally to the hot flow logarithmic spiral; and wherein each of the cold flow channels has a centerline and a width, the centerline and the width of the cold flow channels decreasing exponentially with angular distance as measured from the outlets of the cold flow channels, the outlets of the cold flow channels located at the periphery of the cold flow logarithmic spiral and the inlets of the cold flow channels located centrally to the cold flow logarithmic spiral.

8. The system of claim 7 wherein the cold flow section is configured to be adjacent to and above the hot flow section.

9. The system of claim 8 wherein each of the hot flow channels has a rectangular cross section and each of the cold flow channels has a rectangular cross section.

10. The system of claim 9 wherein the common interface is comprised of one or more insulated plates and a quantity of heat pipes, each heat pipe having an evaporator section protruding through the one or more insulated plates into the one or more of the quantity of hot flow channels and having a corresponding condensation section protruding through the one or more insulated plates into the corresponding one or more of the quantity of cold flow channels, wherein the density of the heat pipes decreases with angular distance as measured from the inlets of the hot flow channels.

11. An energy exchanger for exchanging energy between a hot flow and a cold flow, the energy exchanger comprising:

a hot flow channel forming a hot flow logarithmic spiral and having a variable cross section, the hot flow channel comprising a hot flow inlet, a hot flow outlet, and a passage having a length for the hot flow to move from the hot flow inlet to the hot flow outlet;

a cold flow channel forming a cold flow logarithmic spiral congruent to the hot flow logarithmic spiral and having a variable cross section, the cold flow channel comprising a cold flow inlet, a cold flow outlet, and a passage having a length for the cold flow to move from the cold flow inlet to the cold flow outlet, the cold flow outlet adjacent to the hot flow inlet and the cold flow inlet adjacent to the hot flow outlet such that the hot flow and the cold flow move in opposing directions through the energy exchanger;

a liquid distribution system for distributing a liquid for evaporation into the cold flow channel;

a common interface between the hot flow channel and the cold flow channel, the common interface having a varying surface area in the hot flow channel tapering at an exponential rate from the hot flow inlet to the hot flow outlet and adapted for transferring latent energy released by the hot flow through condensation, and a varying surface area in the cold flow channel tapering at the same exponential rate as the surface area in the hot flow channel from the cold flow outlet to the cold flow inlet and adapted for transferring the latent energy for absorption by the cold flow through evaporation of the liquid into the cold flow;

wherein the exponential variation in the hot flow channel surface area of the common interface maintains the hot flow at saturation, reduces a vapor partial pressure in proportion to the tapering of the hot flow channel surface area, and reduces a temperature of the hot flow linearly along the length of the hot flow channel, and wherein the exponential variation in the cold flow channel surface area of the common interface maintains the cold flow at saturation, increases a vapor partial pressure in inverse proportion to the tapering of the hot flow channel surface area, and increases a temperature of the cold flow linearly along the length of the cold flow channel such that there is a constant temperature difference between the hot flow and the cold flow as measured at any angular distance from the inlet of the hot flow channel and as measured from the outlet of the cold flow channel.

12. The system of claim 11 further comprising a liquid removal system for removing condensate from the hot flow section and residual liquid from the cold flow section.

13. The energy exchanger of claim 12 wherein the hot flow channel and the cold flow channel are adjacent to each other, and the common interface comprises one or more insulated plates and a quantity of heat pipes, each heat pipe having an evaporation section protruding through the one or more insulated plates into the hot flow channel and having a corresponding condensation section protruding through the one or more insulated plates into the cold flow channel, wherein a number of heat pipes per unit of angular distance decreases from the inlets of the hot flow channels to the outlets of the hot flow channels.

14. The energy exchanger of claim 13 wherein the hot flow channel and the cold flow channel are coaxial and have a common vertical axis of rotation, and the common interface comprises one or more insulated plates and a quantity of heat pipes, each heat pipe having an evaporation section protruding through the one or more insulated plates into the hot flow channel and having a corresponding condensation section protruding through the one or more insulated plates into the cold flow channel, wherein a number of heat pipes per unit of angular distance decreases from the inlets of the hot flow channels to the outlets of the hot flow channels.

15. A method for exchanging latent and sensible energy between a hot flow and a cold flow comprising:

injecting the hot flow into a hot flow section of an energy exchanger, the hot flow section comprising a quantity of hot flow channels, each of the hot flow channels having a variable cross section and comprising a hot flow inlet, a hot flow outlet, and a passage having a length for hot flow to move from the hot flow inlet to the hot flow outlet;

injecting the cold flow into a cold flow section of the energy exchanger, the cold flow section comprising a quantity of cold flow channels, each of the cold flow channels having a variable cross section comprising a cold flow inlet, a cold flow outlet, and a passage having a length for the cold flow to move from the cold flow inlet to the cold flow outlet, the quantity of cold flow channels being the same as the quantity of hot flow channels, the inlets of the cold flow channels juxtaposed to the outlets of hot flow channels, the outlets of the cold flow channels juxtaposed to the inlets of the hot flow channels such that the hot flow and cold flow move in opposing directions through the energy exchanger;

injecting a liquid into each of the cold flow channels through a liquid distribution system;

exchanging energy across a common interface between each hot flow channel and a corresponding cold flow channel, the common interface comprising a varying surface area in each of the hot flow channels and each of the cold flow channels, the varying surface areas configured for exchanging latent energy released through condensation in the hot flow section and absorbed through evaporation in the cold flow section, the varying surface areas in the hot flow channels tapering at an exponential rate from the inlets of the hot flow channels to the outlets of the hot flow channels and the varying surface areas of the cold flow channels expanding at an inverse of the hot flow channel exponential tapering rate from inlets of the cold flow channels to the outlets of the cold flow channels;

maintaining the hot flow at saturation;

reducing a vapor partial pressure of the hot flow in proportion to the tapering of the varying surface area in the hot flow channels;

reducing a temperature of the hot flow linearly along the length of the hot flow channels;

distributing liquid into each of the cold flow channels;

maintaining the cold flow at saturation;

increasing a vapor partial pressure of the cold flow in proportion to the expansion of the varying surface area in the cold flow channels;

increasing a temperature of the cold flow linearly along the length of the cold flow channels such that there is constant temperature difference between the hot flow and the cold flow at any distance as measured from the inlets of the hot flow channels and as measured from the outlets of the corresponding cold flow channels;

removing condensate from the hot flow section;

removing residual liquid from the cold flow section;

expelling the hot flow through the outlets of the hot flow channels: and expelling the cold flow through the outlets of the cold flow channels;

wherein the maintaining the hot flow at saturation, the reducing a vapor partial pressure of the hot flow, the reducing a temperature of the hot flow, the maintaining the cold flow at saturation, the increasing a vapor partial pressure of the cold flow, and the increasing a temperature of the cold flow are controlled by a combination of the varying surface areas of the common interface, the variations of the cross sections of the hot flow channels and the variations of the cross sections of the cold flow channels.

16. The method of claim 15 wherein the common interface comprises a varying heat transfer surface in each of the hot flow channels and a corresponding varying heat transfer surface in each of the cold flow channels, each varying heat transfer surface in the hot flow channels is connected thermally to its corresponding varying heat transfer surface in the cold flow channels and wherein the liquid distribution system comprises one or more pipes for distributing the liquid into each of the cold flow channels close to the varying heat transfer surface areas in the cold flow channels.

17. The method of claim 16 wherein at least one dimension of the variable cross section of each hot flow channel forms a logarithmic spiral along the length of the hot flow channel and at least one dimension of the variable cross section of each cold flow channel forms a cold flow logarithmic spiral congruent to the hot flow logarithmic spiral along the length of the cold flow channel.

18. The method of claim 17 wherein the common interface is comprised of one or more insulated plates and a quantity of heat pipes, each heat pipe having an evaporation section protruding through the one or more insulated plates into the one of the quantity of hot flow channels and having a corresponding condensation section protruding through the one or more insulated plates into the corresponding one of the quantity of cold flow channels, wherein the density of the heat pipes decreases with increasing angular distance as measured from the inlets of the hot flow channels.

19. The method of claim 18 wherein the cold flow section is configured to be adjacent to and above the hot flow section.

20. The method of claim 19 wherein each of the hot flow channels has a rectangular cross section and each of the cold flow channels has a rectangular cross section.

* * * * *